US006618958B2

(12) United States Patent
Myung et al.

(10) Patent No.: US 6,618,958 B2
(45) Date of Patent: Sep. 16, 2003

(54) LAUNDRY DRYER AND REAR PLATE FOR DRUM THEREOF

(75) Inventors: Hwan-Joo Myung, Seoul (KR); Sang-Heon Yoon, Seoul (KR); Sung-Bae Song, Seoul (KR); Sang-Wook Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/216,221

(22) Filed: Aug. 12, 2002

(65) Prior Publication Data

US 2003/0136022 A1 Jul. 24, 2003

(30) Foreign Application Priority Data

Jan. 21, 2002 (KR) ..... 2002-03325

(51) Int. Cl.[7] ..... F26B 11/02
(52) U.S. Cl. ..... 34/602; 34/138; 34/139
(58) Field of Search ..... 34/595, 602–607, 34/132, 138, 139, 202

(56) References Cited

U.S. PATENT DOCUMENTS

| | | | | | |
|---|---|---|---|---|---|
| 2,608,769 | A | * | 9/1952 | O'Neil | 34/131 |
| 3,854,219 | A | * | 12/1974 | Staats | 34/265 |
| 3,892,048 | A | * | 7/1975 | Jacobsen, Jr. | 34/604 |
| 4,360,977 | A | * | 11/1982 | Frohbieter | 34/86 |
| 4,468,867 | A | * | 9/1984 | Iwase | 34/82 |
| 4,653,200 | A | * | 3/1987 | Werner | 34/82 |
| 4,689,896 | A | * | 9/1987 | Narang | 68/20 |
| 4,765,162 | A | * | 8/1988 | Ouellette | 68/23.2 |
| 5,582,040 | A | * | 12/1996 | Khan | 34/595 |
| 5,701,684 | A | * | 12/1997 | Johnson | 34/327 |
| 5,706,588 | A | * | 1/1998 | Dausch et al. | 73/865.9 |
| 5,809,828 | A | * | 9/1998 | Gardell et al. | 34/609 |
| 6,006,445 | A | * | 12/1999 | Large | 709/310 |
| 2003/0014880 | A1 | * | 1/2003 | Baurmann | 709/310 |

FOREIGN PATENT DOCUMENTS

| | | | | | |
|---|---|---|---|---|---|
| JP | 05-184792 | A | * | 7/1993 | D06F/58/28 |
| JP | 05-184793 | A | * | 7/1993 | D06F/58/28 |
| JP | 05-220297 | A | * | 8/1993 | D06F/58/02 |
| JP | 06-339595 | A | * | 12/1994 | D06F/58/02 |

OTHER PUBLICATIONS

Nice, Karim. "How Clothes Dryers Work." http://www.howstuffwork.com. Accessed Jan. 26, 2003. pp. 1–14.*

* cited by examiner

*Primary Examiner*—Denise L. Esquivel
*Assistant Examiner*—Andrea M. Ragonese
(74) *Attorney, Agent, or Firm*—Birch, Stewart, Kolasch & Birch, LLP

(57) ABSTRACT

A laundry dryer has a drum rotatively installed inside a case, a heater heating air flowing inside the drum, a rear plate coupled so as to cover a rear portion of the drum and having a vertically elongated inlet hole traversing upper and lower areas of the drum body, a central portion of the vertically elongated inlet hole crossing a horizontal line of the rear plate, and an inlet duct covering the inlet hole and simultaneously having a plurality of duct holes formed at a portion covering the inlet hole so as to guide air heated by the heater to flow inside the drum. The present invention enables the common use of the rear plate for both electrical and gas laundry dryers, and thus allows the use of a common line for assembly. Therefore, the present invention reduces product costs and increases productivity.

20 Claims, 8 Drawing Sheets

LAUNDRY DRYER AND REAR PLATE FOR DRUM THEREOF

BACKGROUND OF THE INVENTION

1. Field of the Invention

The present invention relates to a laundry dryer, and more particularly, to a laundry dryer and a rear plate for a drum thereof enabling to apply a rear plate of a drum to an electric laundry dryer and a gas type laundry dryer in common.

2. Discussion of the Background Art

Generally, a laundry dryer is installed separately from a washer so as to dry wet laundry automatically after completion of washing.

An example of such a laundry dryer is schematically illustrated in FIG. 1, and a background art laundry dryer is explained by referring to FIG. 1 as follows.

Referring to FIG. 1, an opening 1*a* is formed at a front of a case 1 so as to put in or remove laundry, and the opening is closed or opened by a door 2.

A drum 30 in which inputted laundry is dried is rotatively installed inside the case 1, and a driving motor 4 generating a turning force is installed at a lower part of the drum 30. A pulley 5 and a belt 6 are connected between the driving motor 4 and drum 30 so as to transfer turning power to the drum 30.

The drum 30 includes a cylindrical drum body 31 of which both sides are open, a front plate 33 coupled with a front portion of the drum body 31 and having a laundry input opening 33*b* at a central portion, and a rear plate 35 coupled with a rear portion of the drum body 31.

An inlet hole 35*a* is formed at the rear plate 35 of the drum 30, and an inlet duct 10 guiding external air inside the drum 30 is coupled with the inlet hole 35*a*. A heater 8 is installed at an entrance of the inlet duct 10 so as to heat the air introduced through an air intake lb of the case 1 into hot and dry air.

An outlet hole 33*a* is formed at the front plate 33, and an outlet duct 9 guiding air discharged from the drum 30 to the outside is coupled with the outlet hole 33*a*. A blow fan 7 driven by the driving motor 4 is installed inside the outlet duct 9 so as to make the air in the drum 30 flow forcibly.

Numerals 'C' and 'F' in FIG. 1 indicate a laundry and a filter, respectively.

Operation of the laundry dryer according to the background art is carried out as follows.

A user opens the door 2, puts wet laundry C and the like inside the drum 30 through the opening 1*a*, and then pushes a start button to actuate the driving motor 4 so that the driving motor 4 rotates to generate a turning force. The turning force of the driving motor 4 is then transferred to the drum 30 through the pulley 5 and belt 6 so as to rotate the body 31 of the drum 30. Hence, the laundry C inside the drum 30 is mixed.

Simultaneously, the blow fan 7 is actuated to rotate so as to make the external air flow into the drum 30 through the inlet duct 10 and inlet hole 35*a*. In this case, the suctioned air is heated by the heater 8 and changed into a very dry and hot air having very low humidity. The drum is supplied with the dry and hot air to dry the laundry C inside the drum 30.

Moreover, the dry air inside the drum 30 comes into contact with the wet laundry to remove the humidity from the laundry, and then is discharged outside the case 1 through the outlet duct 9. In this case, the filter F removes pile, waste thread, and the like from the discharge air.

Drying performance of such a laundry dryer depends mostly on the active contact between the wet laundry C and the dry air flowing inside the drum 30. Various study and research teaches that a factor having the biggest influence on a flow of the dry air passing through the drum 30 is the position and shape of the inlet hole 35*a* formed at the rear plate 35.

The position of the inlet hole 35*a* formed at the rear plate 35 according to the background art and a structure of the inlet duct 10 connected to the inlet hole 35 are explained by referring to FIG. 2 and FIG. 3 as follows.

Referring to FIG. 2, the rear plate 35 has a disk shape, and the inlet hole 35*a* is formed at a left upper position of the rear plate 35.

Referring to FIG. 3, the inlet duct 10 is constructed with a pair of plates 11 and 12 assembled with each other so as to form a path for the dry air. An entrance 11*c* is formed at a lower portion of the inlet duct 10 to make hot air flow in by being coupled with the heater 8, and a plurality of duct holes 11*a* are formed at an upper portion of the inlet duct 10 to correspond to the inlet hole 35*a* of the rear plate 35.

A total open area of the duct holes 11*a* is generally formed to cover about 40% of the open area of the inlet hole 35A.

When the inlet hole 35*a* is formed at the upper position of the rear plate 35, as shown in FIG. 4, the air drawn inside the drum 30 tends to flow in a direction having a least airflow resistance and the wet laundry tends to be distributed at a lower part of the drum. Hence, the air drawn inside the drum 30 flows as having a speed component preponderating toward about 45° upper side for the rotating axis of the drum 30.

Accordingly, the hot and dry air drawn inside the drum 30 fails to be contacted with the wet laundry C actively so as to be discharged through the outlet duct 9. Thus, the laundry drying time increases and energy efficiency decreases.

The inlet hole 35*a* in the laundry dryer according to the background art is positioned at the upper portion of the rear plate 35, thereby becoming disadvantageous with regard to drying performance.

In spite of such disadvantages, the reason why the inlet hole 35*a* is designed to be located at the upper portion of the rear plate 35 is as follows.

Generally, laundry dryers are divided into an electrical laundry dryer and a gas type laundry dryer in accordance with the form of using the heater 8. The electrical laundry dryer includes an electric hot wire for heating air, while the gas type laundry dryer includes a nozzle jetting a gas so that the air is heated in a manner that the jetted gas reacts with suctioned air for combustion.

Specifically, the gas type laundry dryer should secure at least a predetermined length of the inlet duct 10 for the characteristics of combustion. If the sufficient length of the inlet duct 10 fails to be secured, a flame reaches the inside of the drum 30 so as to cause damage on the laundry C or set it on fire.

For the above safety reasons, the gas type laundry dryer, as shown in FIG. 4, should form the inlet hole 35A at the upper portion of the rear plate 35. Yet, the electrical laundry dryer does not need the long combustion section like the gas type, so therefore the length of the inlet duct 10 can be shortened and the inlet hole 35*a* is installed at the lower portion of the rear plate 35. Hence, the electrical laundry dryer enables to improve the drying performance.

As mentioned through FIG. 1 to FIG. 4, when the positions of the inlet holes 35*a* of the electrical and gas type laundry dryers are set up at the upper portions of the rear plates 35, the same rear plate shown in FIG. 2 can be used regardless of the species of the laundry dryers. Besides, the inlet ducts 10 having different shapes in part are used only case by case. Namely, the inlet duct 10 can be used for both the electrical and gas type laundry dryers. Nevertheless, a vent 11*b* (as a plurality of air paths), as shown in FIG. 3, is added to the inlet duct 10 to dilute the burnt air.

When the inlet hole 35*a* is formed equivalently at the upper portion of the rear plate 35, the inlet duct 10 manufactured differently in accordance with the electrical or gas type can be assembled with the same rear plate 35 by the same assembly process so as to reduce a product cost of the laundry dryer. As such, it is impossible to increase the drying performance of the electrical laundry dryer any more.

On the contrary, if the position of the inlet hole 35*a* is adjusted to fit the characteristics of the electrical or gas type laundry dryer, the product cost of the laundry dryer increases.

Namely, if the inlet hole 35*a* of the electrical laundry dryer is installed at the lower portion of the rear plate 35 in order to improve the drying performance, the position of the inlet hole 35A is different from that of the gas type laundry dryer. Hence, the rear plates 35 for the electrical and gas type laundry dryers should be manufactured using expensive large moldings. Moreover, the inlet ducts 10 applied to the electrical and gas type laundry dryers differ in length, thereby requiring different designs to be manufactured.

Unfortunately, when the position of the inlet hole 35*a* of the electrical laundry dryer is different from that of the gas type laundry dryer, the rear plates 35 and inlet ducts 10 should be manufactured separately as well as assembled using different assembly lines, respectively. Hence, a product cost of the laundry dryer increases greatly.

SUMMARY OF THE INVENTION

Accordingly, the present invention is directed to a laundry dryer and rear plate for a drum thereof that substantially obviates one or more problems due to limitations and disadvantages of the background art.

An object of the present invention is to provide a laundry dryer and a rear plate for a drum thereof enabling to apply a rear plate of a drum to an electric laundry dryer and a gas type laundry dryer in common so as to improve productivity of the laundry dryer as well as reduce product costs.

Another object of the present invention is to provide a laundry dryer and rear plate for a drum thereof enabling to cope with a modification of a position of a hole, through which hot and dry air flows inside a drum, in accordance with design requirements such as drying capacity change of the drum, airflow capacity change of a blowing fan, and the like.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry dryer according to the present invention includes a drum body rotatively installed inside a case, a rear plate coupled so as to cover a rear portion of the drum body and having an inlet hole open from upper to lower sides across upper and lower areas centering around a horizontal line of the rear plate, and an inlet duct connected to the inlet hole of the rear plate so as to guide air to flow inside the drum body wherein the air dries the laundry.

Preferably, a ratio L/D between an upper and lower opening length L of the inlet hole and an outer diameter D of the rear plate is at least 0.45.

Preferably, a covering portion is formed at an end portion of the inlet duct in a flowing direction of the air so as to cover the inlet hole of the rear plate and wherein a plurality of duct holes are formed at the covering portion so that the air passes through the duct holes to flow inside the drum body.

More preferably, an opening area of the inlet hole is at least 375% of a total opening area of the duct holes.

More preferably, an electrical heater heating the air using an electrical coil is installed at an entrance of the inlet duct and wherein the duct holes are distributed on a relatively lower area in the covering portion.

More preferably, the duct holes are distributed in the lower area centering around the horizontal line of the rear plate.

More preferably, a gas type heater heating the air using gas combustion is installed at an entrance of the inlet duct and wherein the duct holes are distributed on a relatively upper area in the covering portion.

More preferably, the duct holes are distributed in the upper area centering around the horizontal line of the rear plate.

More preferably, the covering portion has the same shape of the inlet hole so as to be inserted into the inlet hole for coupling.

Preferably, the inlet hole is positioned at one area centering around a vertical center line of the rear plate.

In another aspect of the present invention, a laundry dryer including a drum rotatively installed inside a case, a heater heating an air flowing inside the drum, a rear plate coupled so as to cover a rear portion of the drum and having an inlet hole open long from upper to lower sides across upper and lower areas centering around a horizontal line of the rear plate, and an inlet duct covering the inlet hole and simultaneously having a plurality of duct holes formed at a portion covering the inlet hole so as to guide the air heated by the heater to flow inside the drum.

Preferably, a ratio L/D between an upper and lower opening length L of the inlet hole and an outer diameter D of the rear plate is at least 0.45.

Preferably, an opening area of the inlet hole is at least 375% of a total opening area of the duct holes.

Preferably, the heater is an electrical type and the duct holes are distributed on the lower area centering around the horizontal line of the rear plate.

Preferably, the heater is a gas type and the duct holes are distributed on the upper area centering around the horizontal line of the rear plate.

Preferably, the inlet hole extends from upper to lower sides across the upper and lower areas centering around the horizontal line of the rear plate to be coupled with an inlet duct guiding airflow inside the drum.

More preferably, a ratio L/D between an upper and lower opening length L of the inlet hole and an outer diameter D of the rear plate is at least 0.45.

More preferably, the inlet hole is covered with a covering means having a plurality of duct holes and an opening area of the inlet hole is at least 375% of a total opening area of the duct holes.

More preferably, the duct holes are distributed on one of the upper and lower areas centering around the horizontal center line of the rear plate.

More preferably, the inlet hole is positioned at one area centering around a vertical center line of the rear plate.

The laundry dryer according to the present invention has the inlet hole connected to the rear plate of the drum from the upper side to the lower side, whereby the identical rear plate can be applied to the electrical laundry dryer using the inlet duct having the duct holes at the lower side or the gas type laundry dryer using the other inlet duct having the duct holes at the upper side.

The present invention has the rear plate for common use, whereby the rear plate need not be manufactured additionally in accordance with the species of the laundry dryer, i.e. electrical or gas type laundry dryer. Therefore, the present invention enables to manufacture the rear plate used for the electrical or gas type laundry dryer for common use using the same metal mold.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

In the drawings.

DETAILED DESCRIPTION OF THE INVENTION

Reference will now be made in detail to the preferred embodiments of the present invention, examples of which are illustrated in the accompanying drawings. Besides, the basic constitution of a laundry dryer according to the present invention is identical to that of the background art, which is skipped in the following description.

Figure 1:
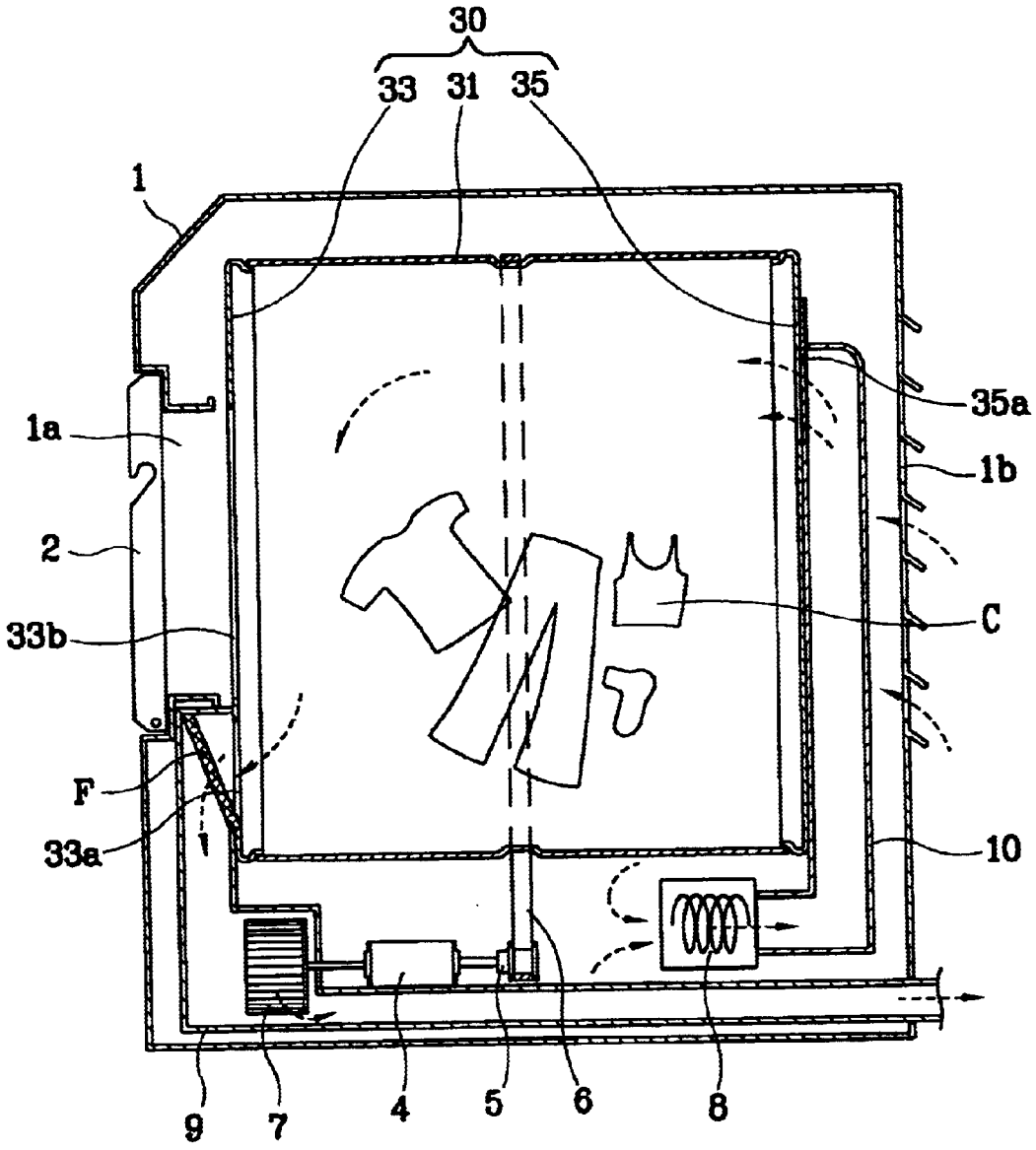
FIG. 1 BACKGROUND ART
FIG. 1 illustrates a cross-sectional view of a laundry dryer according to background art.
Figure 2:
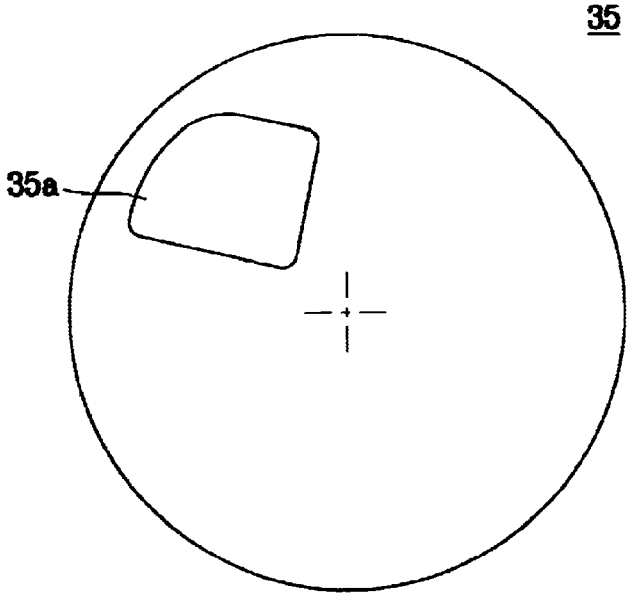
FIG. 2 BACKGROUND ART
FIG. 2 illustrates a layout of a rear plate seen from a rear side of a drum of the laundry dryer in FIG. 1.
Figure 3:
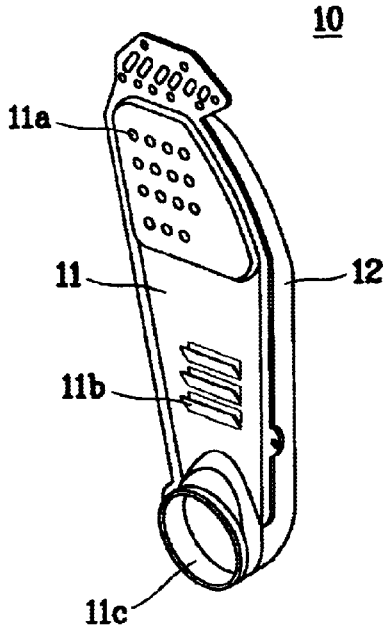
FIG. 3 BACKGROUND ART
FIG. 3 illustrates a bird's-eye view of an inlet duct connected to the rear plate in FIG. 2.
Figure 4:
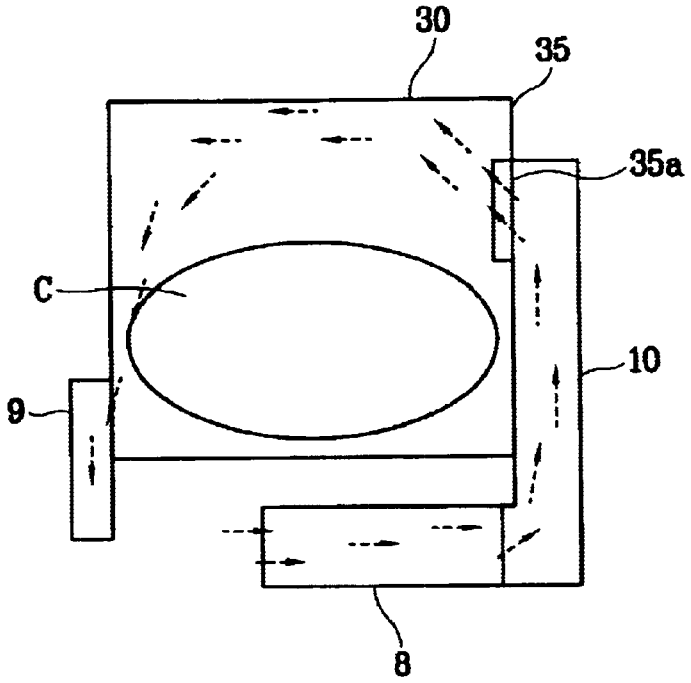
FIG. 4 BACKGROUND ART
FIG. 4 illustrates a schematic diagram of airflow in a laundry dryer according to background art.
Figure 5:
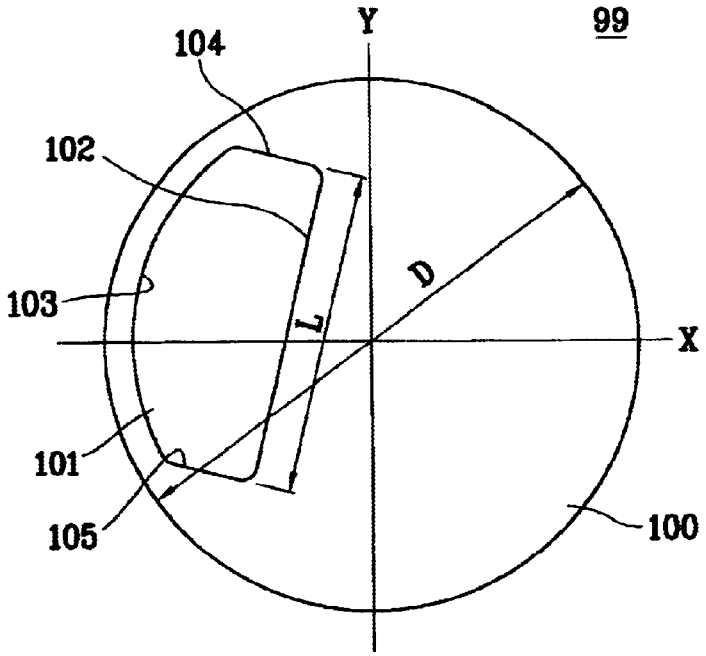
FIG. 5 illustrates a layout of a rear plate of a drum for a laundry dryer according to the present invention.

FIG. 5 illustrates a layout of a rear plate of a drum for a laundry dryer according to the present invention.

Referring to FIG. 5, a drum 99 has a cylindrical structure enabling to rotate inside a case.

A rear plate 100 covering a rear portion of the drum 99 has a disk shape. An inlet hole 101 formed at the rear plate 100 extends lengthwise across an upper semicircle and a lower semicircle centering around a horizontal center line X so as to be coupled with an inlet duct of an electrical laundry dryer or a gas type laundry dryer.

Particularly, the inlet hole 101 is located at one side area centering around a vertical center line Y of the rear plate 100, and simultaneously extends across upper and lower areas centering around the horizontal center line X.

An inner side 102 of the inlet hole 101 located close to a rotational center of the rear plate 100 is formed straight so as to incline to a vertical direction, and an outer side 103 opposing the inner side 102 is rounded along a circumference of the rear plate 100.

Upper and lower sides 104 and 105 connecting the inner and outer sides 102 and 103 are straight so as to be in parallel with each other as well as incline at a predetermined angle to a horizontal direction.

Therefore, the inlet hole 101 has a quadrangular shape extending lengthwise in upper and lower directions, and the outer side 103 has a round shape convex to a circumferential direction of the rear plate 100.

Figure 6A:
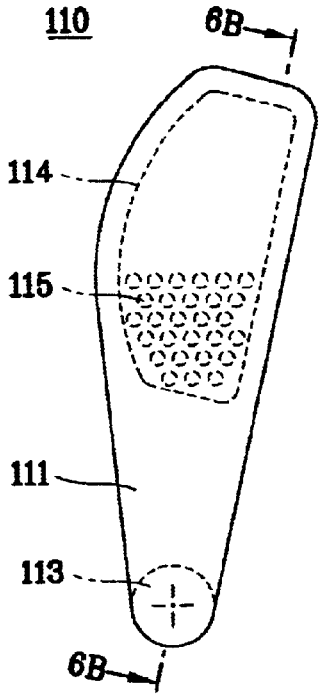
FIG. 6A and FIG. 6B illustrate rear side and cross-sectional views of an inlet duct in an electrical laundry dryer according to the present invention.
Figure 6B:
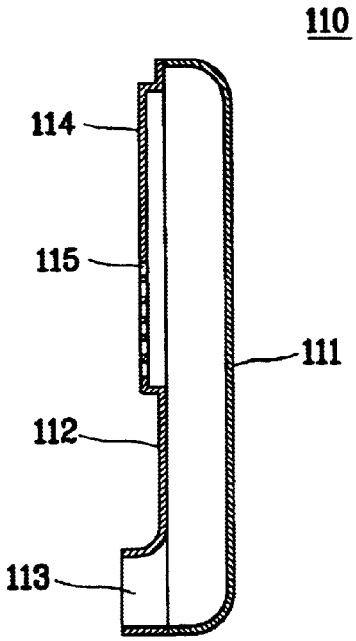
Figure 7:
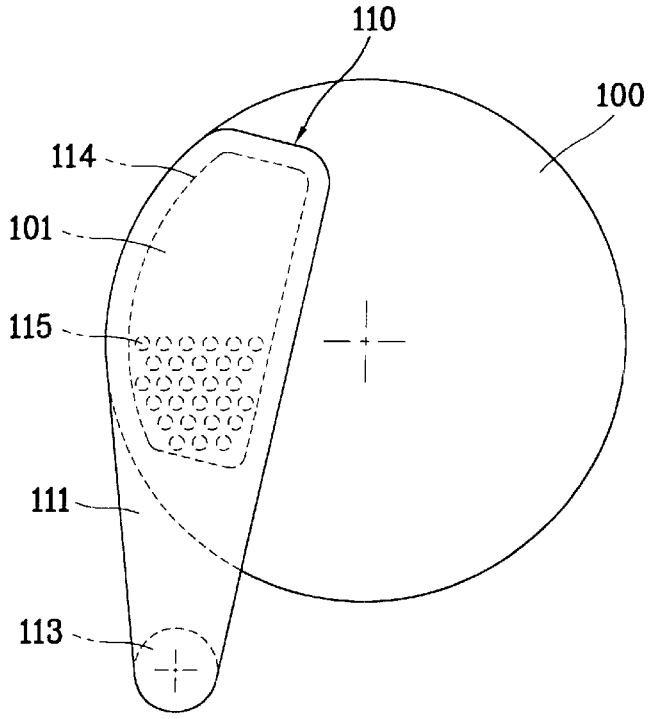
FIG. 7 illustrates a rear side view of the inlet duct in FIG. 6A connected to a rear plate according to the present invention.
Figure 8:
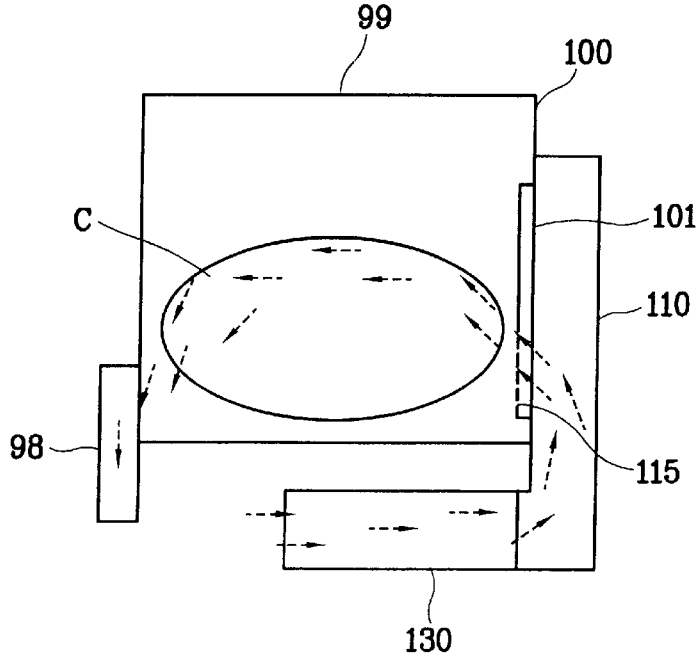
FIG. 8 illustrates a schematic diagram of airflow in an electrical laundry dryer to which the present invention is applied.

FIG. 6A and FIG. 6B illustrate rear side and cross-sectional views of an electrical type inlet duct applied to a rear plate according to the present invention, FIG. 7 illustrates a rear side view of the inlet duct in FIG. 6A assembled with the rear plate according to the present invention, and FIG. 8 illustrates a schematic diagram of airflow in an electrical laundry dryer according to the present invention.

Referring to FIG. 6A and FIG. 6B, an inlet duct 110 for an electrical laundry dryer includes a pair of assembled plates 111 and 112 so as to form a path through which dry air heated through a heater 130 passes. An entrance 113 is formed at a lower portion of the inlet duct 110, which is coupled with the heater 130, to make the dry air flow in. A covering portion 114 is formed at an upper portion of the inlet duct 110 to protrude in a front direction with a predetermined height so as to be inserted in the inlet hole 101 of the rear plate 100.

Specifically, the covering portion 14 is coupled with an electrical laundry dryer so that a plurality of duct holes 115 are formed at a lower area of the covering portion 114.

The inlet duct 110, as shown in FIG. 7, is coupled with a left side of the rear plate 100, and the duct holes 115 are distributed on a lower area centering around a horizontal center line of the rear plate 100. It is a matter of course that a portion of the inlet hole 101 of the rear plate 100 failing to be inter-connected to the duct holes 115 is blocked by the covering portion 114 of the inlet duct 110.

Therefore, in the electrical laundry dryer coupled with the rear plate 100 and inlet duct 110, as shown in FIG. 8, air dried through the heater 130 flows in a lower side of a drum 99 through the inlet duct 110 and duct holes 115, comes into contact with wet laundry, and then is discharged outside through an outlet duct 98.

Figure 9A:
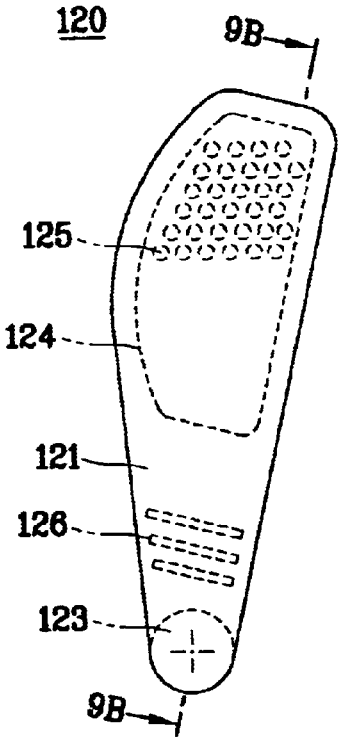
FIG. 9A and FIG. 9B illustrate rear side and cross-sectional views of an inlet duct in a gas type laundry dryer according to the present invention.
Figure 9B:
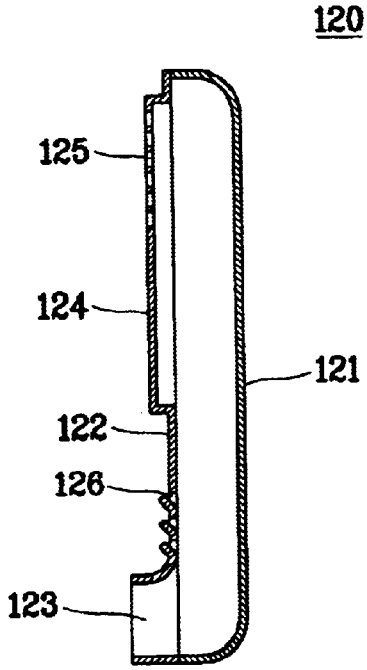
Figure 10:
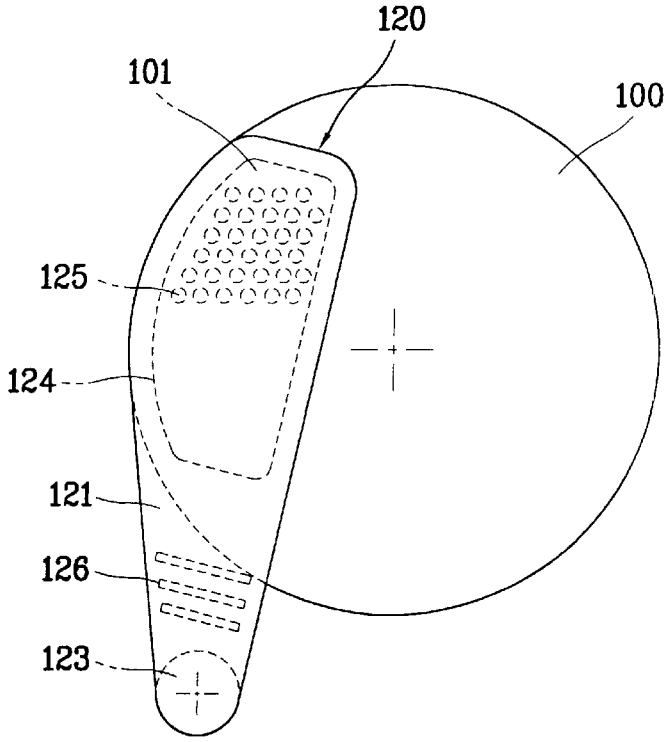
FIG. 10 illustrates a rear side view of the inlet duct in FIG. 9A connected to a rear plate according to the present invention.
Figure 11:
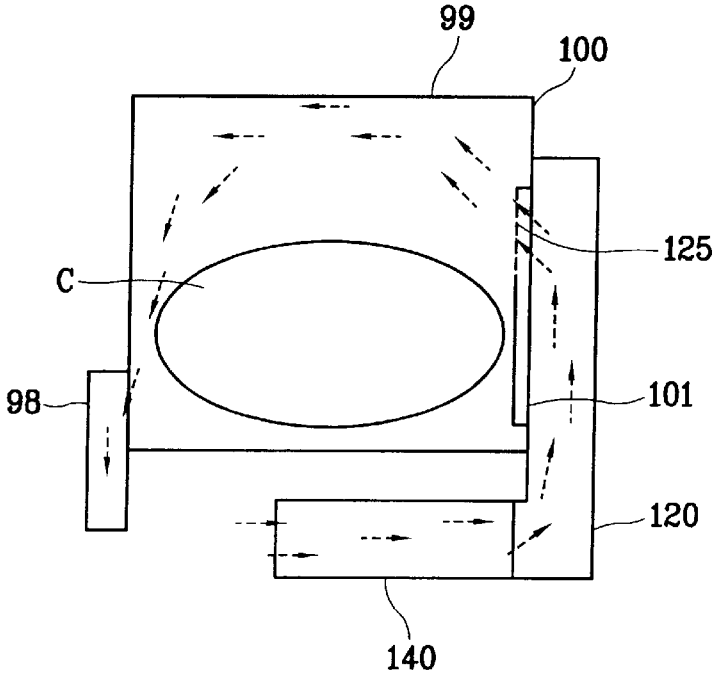
FIG. 11 illustrates a schematic diagram of airflow in a gas type laundry dryer to which the present invention is applied.

FIG. 9A and FIG. 9B illustrate rear side and cross-sectional views of an inlet duct for a gas type laundry dryer which is applied to a rear plate according to the present invention, FIG. 10 illustrates a rear side view of the inlet duct assembled with the rear plate according to the present invention, and FIG. 11 illustrates a schematic diagram of airflow in a gas type laundry dryer according to the present invention.

Referring to FIG. 9A and FIG. 9B, an inlet duct 120 for a gas type laundry dryer includes a pair of assembled plates 121 and 122 like the inlet duct for the electrical laundry dryer. An entrance 123 is formed at a lower portion of the inlet duct 120, and a covering portion 124 is formed at an upper portion of the inlet duct 120 so as to be inserted in the inlet hole 101 of the rear plate 100 for coupling.

A plurality of duct holes 125 are distributed on the covering portion 124 at an area relatively higher than that for the above-described electrical laundry dryer.

A vent 126 as a plurality of air paths is additionally formed between the covering portion 124 and entrance 123.

The above-constituted inlet duct 120, as shown in FIG. 10, is coupled with a left side of the rear plate 100, and the duct holes 125 are distributed on an upper area centering around a horizontal center line of the rear plate 100. The inlet hole 101 is blocked by the covering portion 124.

Therefore, in the gas type laundry dryer coupled with the rear plate 100 and inlet duct 120, as shown in FIG. 11, an air heated and dried through a gas type heater 140 flows in an upper side of a drum 99 through the inlet duct 120 and duct holes 125, comes into contact with wet laundry actively in the drum 99, and then is discharged outside through an outlet duct 98.

In this case, the duct holes 125 are positioned at an upper side in the rear plate 100, thereby enabling to secure a sufficient combustion section from the heater 140 to the duct holes 125.

Therefore, the inlet hole 101 extends long from the upper area to the lower area centering around a center of the rear plate 100 according to the present invention, whereby the same rear plate 100 can be applied to both the electrical and gas type laundry dryers for common use.

Meanwhile, in order to secure drying performance of the electrical laundry dryer and a combustion section of the gas type laundry dryer, a shown in FIG. 5, it is preferable that a ratio L/D between an opening length L of the inlet hole 101 and a diameter D of the rear plate 100 is set up as at least 0.45.

Moreover, an opening area of the inlet hole 101 is preferably formed to be at least 375% of a total opening area of the duct holes 115 or 125 formed at the inlet duct 110 or 120.

The relation between the upper and lower length L of the inlet hole 101 and diameter D of the rear plate and the other relation between the opening areas of the inlet hole and duct holes are explained in detail by referring to FIG. 12 and FIG. 13 as follows.

Figure 12:
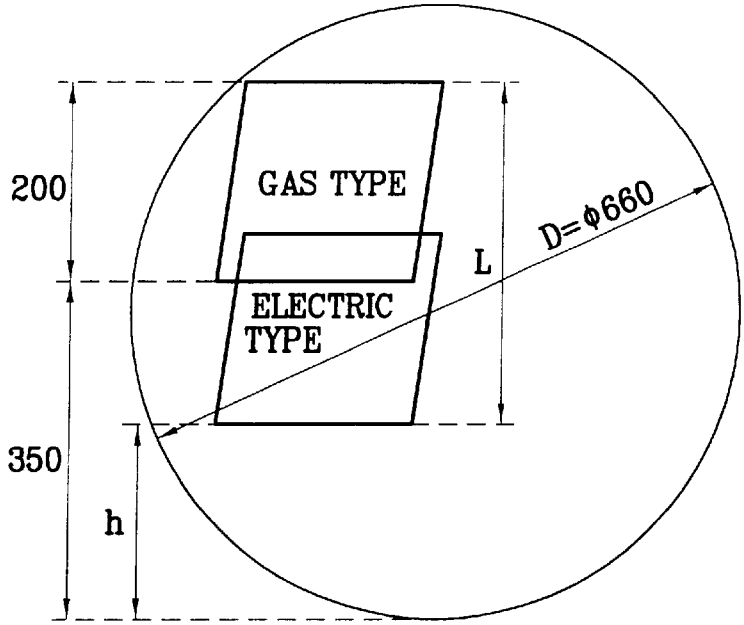
FIG. 12 illustrates a diagram of a designed position of an inlet hole in a rear plate according to the present invention.

Referring to FIG. 12, a diameter D of a rear plate 100 like a general rear plate applied to a general laundry dryer is set up as 660 mm.

An inlet hole indicated as 'GAS TYPE' in FIG. 12 has the same size of the inlet hole used for the laundry dryer according to the background art, where a distribution height of the inlet hole(duct hole) is 200 mm. A distance between a lowest end of the rear plate and a lower end of the inlet hole(duct hole) is a combustion section, and should be at least 350 mm. Being advantageously positioned lower, the distance is generally designed to be 350 mm.

A position of the inlet hole(duct hole) is about 150 mm from the lowest end of the rear plate so that the electrical type, which is unnecessary to consider the minimum height of the combustion section, shows its best drying performance(minimum drying time).

Hence, it is preferable that the length of the inlet hole according to the present invention enabling to include all the duct holes of the electrical and gas types is set up as 400 mm. In this case, the ratio L/D between the diameter D of the rear plate and length L of the inlet hole is preferably set up as about 0.6.

Figure 13:
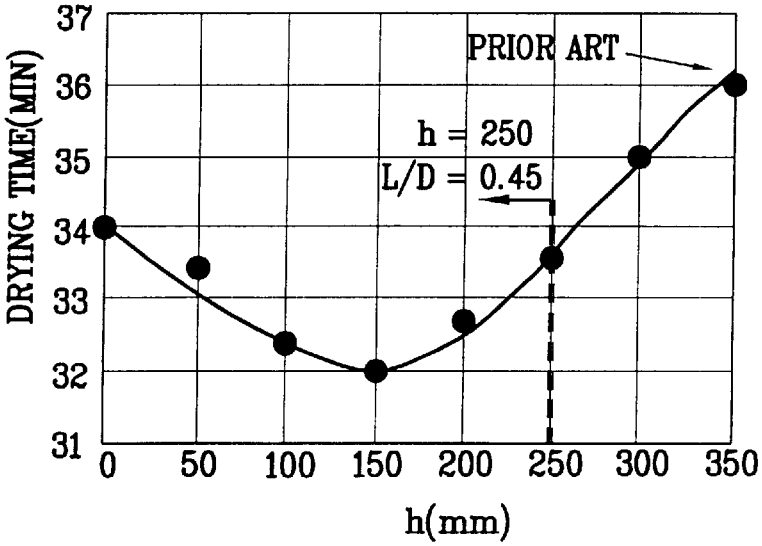
FIG. 13 illustrates a graph of relation between drying time and a position of an inlet hole.

Referring to FIG. 13, compared to a right area of a dotted line where the inlet hole of the background art is located, a left area of the dotted line shows that the drying time is reduced so as to improve the drying performance when a height h from the lowest end of the rear plate 100 is lower than about 250 mm.

In this case, if the height h as a reference of the dotted line is 250 mm, L/D=(550−250)/660=0.45. In order to achieve the objectives of the present invention, the ratio L/D between the length L of the inlet hole and diameter D of the rear plate exceeds 0.45 enough to secure sufficient drying performance and be applied to both the electrical and gas types for common use.

Moreover, the duct holes of the laundry dryer according to the background art are densely constructed with small circular holes across a total area of the inlet hole, and a corresponding opening ratio of the duct holes is about 40% of the opening area of the inlet hole. On the contrary, the opening ratio of the inlet hole becomes about 250% of the total opening area of the duct holes.

The area of the duct holes of the present invention has no difference from that of the background art. Yet, the area of the inlet hole 101 of the present invention increases up to at least 1.5 times (h=250 mm) so that the opening area of the inlet hole 101 is preferably over 375% of the total opening area of the duct holes 115 or 125.

Operation and effect of the above-constituted laundry dryer according to the present invention are explained as follows.

The rear plate 100 according to the present invention has the inlet hole 101 extending lengthwise from upper to lower sides of the horizontal center line X of the rear plate 100, thereby enabling to use the inlet duct 110 for the electrical laundry dryer having the duct holes 115, as shown in FIG. 6A and FIG. 6B, formed at a lower side.

Moreover, since the dry air, as shown in FIG. 8, flows in the lower side of the drum 99 through the inlet duct 110 so as to move in a central direction for active contact with the wet laundry, thereby enabling to improve drying performance.

The rear plate 100 according to the present invention, as shown in FIG. 9A and FIG. 9B, can be applied to the case that the inlet duct 120 of the gas type laundry dryer, which has the duct holes 125 positioned at the upper side to secure the combustion section, is used. Namely, the rear plate 100 applied to the electrical laundry dryer is used as it is, and the inlet duct 120 of the gas type laundry dryer having the duct holes 125 formed at the upper side can be applied thereto. Hence, it is able to use the same rear plate 100 for the electrical or gas type laundry dryer for common use.

Meanwhile, in the laundry dryer according to the present invention, the inlet hole 101 of the rear plate 100 extends long from the upper to lower sides centering around the horizontal center line X and the covering portion of the inlet duct 110 or 120 is connected to the inlet hole 101. Hence, the present invention enables to cope conveniently with the modification of the shape or position of the duct holes in accordance with a drying capacity change due to length variation of the drum and an airflow change of the blow fan by adjusting the position or area of the duct holes formed at the inlet duct without changing the design of the rear plate.

As explained in detail in the above description, the laundry dryer according to the present invention has the inlet hole connected long from upper to lower sides to the rear plate of the drum, thereby enabling to apply the same shaped rear plate to the electrical laundry dryer including the inlet duct which has the duct holes positioned at the lower side or the gas type laundry dryer including the inlet duct which has the duct holes positioned at the relatively upper side.

The present invention enables the rear plate to be used for common use, and it is unnecessary to manufacture an additional rear plate in accordance with the species of the laundry dryer such as electrical or gas types. Therefore, the present invention uses the same metal mold to produce the rear plate used for the electrical and gas type laundry dryers without using an additional metal mold, thereby enabling to improve productivity as well as reduce product costs.

Moreover, the inlet duct couplet with the rear plate only needs to change the position of the duct holes in accordance with the species of the laundry dryer, thereby enabling to reduce product costs and assembly costs despite the changed species of the laundry dryer.

After all, the present invention enables the common use of the rear plate for the electrical and gas type laundry dryers so as to assemble the rear plate using the same assembly line. Therefore, the present invention enables to reduce product costs as well as improve productivity.

Besides, the electrical laundry dryer according to the present invention uses the inlet duct having the duct holes formed at the lower side to supply the heated air from the lower side of the drum in a central direction, whereby a drying performance is improved over 10%.

The foregoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A laundry dryer comprising:

a drum body rotatively installed inside a case;

a detachable rear plate covering a rear portion of the drum body and having a vertically elongated inlet hole traversing upper and lower areas of said drum body, a central portion of said vertically elongated inlet hole crossing a horizontal center line of the rear plate; and an inlet duct connected to the inlet hole of the rear plate positioned to guide air to flow inside the drum body wherein the air dries laundry.

2. The laundry dryer of claim 1, wherein a ratio L/D between an upper and lower opening length L of the inlet hole and an outer diameter D of the rear plate is at least 0.45.

3. The laundry dryer of claim 1, wherein a covering portion is formed at an end portion of the inlet duct in a flowing direction of the air and positioned to cover the inlet hole of the rear plate and wherein a plurality of duct holes are formed at the covering portion so that the air passes through the duct holes to flow inside the drum body.

4. The laundry dryer of claim 3, wherein an opening area of the inlet hole is at least 375% of a total opening area of the duct holes.

5. The laundry dryer of claim 3, wherein an electrical heater heating the air using an electrical hot coil is installed at an entrance of the inlet duct and wherein the duct holes are distributed on a lower area in the covering portion.

6. The laundry dryer of claim 5, wherein the duct holes are distributed in the lower area and centering around the horizontal line of the rear plate.

7. The laundry dryer of claim 3, wherein a heater which heats the air using gas combustion is installed at an entrance of the inlet duct and wherein the duct holes are distributed on an upper area in the covering portion.

8. The laundry dryer of claim 7, wherein the duct holes are distributed in the upper area and centering around the horizontal line of the rear plate.

9. The laundry dryer of claim 3, wherein the covering portion has the same shape of the inlet hole and positioned to be inserted into the inlet hole.

10. The laundry dryer of claim 1, wherein the inlet hole is positioned at an area centering around a vertical center line of the rear plate.

11. A laundry dryer comprising:

a drum rotatively installed inside a case;

a heater heating an air flowing inside the drum;

a detachable rear plate covering a rear portion of the drum and having a vertically elongated inlet hole traversing upper and lower areas of said drum body, a central portion of said vertically elongated inlet hole crossing a horizontal center line of the rear plate; and an inlet duct covering the inlet hole and simultaneously having a plurality of duct holes formed at a portion covering the inlet hole so as to guide the air heated by the heater to flow inside the drum.

12. The laundry dryer of claim 11, wherein a ratio L/D between an upper and lower opening length L of the inlet hole and an outer diameter D of the rear plate is at least 0.45.

13. The laundry dryer of claim 11, wherein an opening area of the inlet hole is at least 375% of a total opening area of the duct holes.

14. The laundry dryer of claim 11, wherein the heater is an electrical type and the duct holes are distributed on the lower area centering around the horizontal line of the rear plate.

15. The laundry dryer of claim 11, wherein the heater is a heater which heats the air using gas combustion, and the duct holes are distributed on the upper area and centering around the horizontal line of the rear plate.

16. The laundry dryer of claim 11, wherein the inlet hole extends lengthwise from upper to lower sides across the upper and lower areas centering around the horizontal line of the rear plate positioned to be coupled with an inlet duct guiding an airflow inside the drum.

17. The laundry dryer of claim 16, wherein a ratio L/D between an upper and lower opening length L of the inlet hole and an outer diameter D of the rear plate is at least 0.45.

18. The laundry dryer of claim 16, wherein the inlet hole is covered with a covering means having a plurality of duct holes and an opening area of the inlet hole is at least 375% of a total opening area of the duct holes.

19. The laundry dryer of claim 18, wherein the duct holes are distributed on one of the upper and lower areas centering around the horizontal center line of the rear plate.

20. The laundry dryer of claim 16, wherein the inlet hole is positioned at an area centering around a vertical center line of the rear plate.

* * * * *